United States Patent [19]

Chamran et al.

[11] 4,417,180

[45] Nov. 22, 1983

[54] LAMP FIRING APPARATUS

[75] Inventors: Morteza M. Chamran, Elmhurst; Milan Dimovski, Countryside, both of Ill.

[73] Assignee: The Perkin-Elmer Corporation, Norwalk, Conn.

[21] Appl. No.: 240,650

[22] Filed: Mar. 5, 1981

[51] Int. Cl.[3] ..... H05B 41/23

[52] U.S. Cl. ..... 315/175; 315/171; 315/173; 315/205; 315/360

[58] Field of Search ..... 315/86, 171, 173, 175, 315/176, 205, 241 R, 360, 362, DIG. 7; 307/75, 81, 87

[56] References Cited

U.S. PATENT DOCUMENTS

| | | | |
|---|---|---|---|
| 3,467,886 | 9/1969 | Alley | 315/176 X |
| 3,500,128 | 3/1970 | Liepins | 315/360 X |
| 3,629,647 | 12/1971 | Lake | 315/205 X |
| 4,260,932 | 4/1981 | Johnson | 315/205 |

*Primary Examiner*—Eugene R. Laroche

*Attorney, Agent, or Firm*—S. A. Giarratana; F. L. Masselle; R. A. Hays

[57] ABSTRACT

A discharge lamp firing apparatus is disclosed which includes providing only the necessary firing voltage to the lamp prior to the firing thereof. As such, the surrounding system is not subjected to transients caused by conventional mechanisms which suddenly switch an extremely high voltage across the lamp. As a result, the present apparatus protects the associated circuitry as well as prevents needless overvoltage conditions to the lamp.

9 Claims, 3 Drawing Figures

LAMP FIRING APPARATUS

BACKGROUND OF THE INVENTION

The present invention generally relates to an apparatus for firing a discharge lamp and, in particular, relates to such an apparatus which reduces transients resulting from the firing of the lamp.

In many modern analytical instruments the optical segment of the instrument often includes an arc lamp which emits light within a selected spectrum of wavelengths. As one example, a conventional spectrophotometer utilizes a deuterium gas arc lamp for producing a continuous spectrum of wavelengths from about 190 nm to about 340 nm. Depending on the spectrum desired, lamps having other materials, such as Xenon, can also be used.

In effect, such lamps require two different voltages for proper operation. That is, a firing voltage and a sustaining voltage. Additionally, there may also be a heater for the cathode or electron emitter to which a low voltage is first applied for a short period of time to generate free electrons within the lamp. Thereafter, the firing voltage is applied across the lamp to fully ionize the gas therein. Once the gas is ionized, the firing voltage is removed and a sustaining voltage is applied to maintain the gas in its ionized state. Such a heater, if used, may need voltage continuously applied thereto unless the cathode remains hot enough due to ion bombardment.

A difficulty with such lamps is that the firing voltage and the sustaining voltage change, usually by increasing, over a period of time. The rate of change of these voltages with time is unpredictable. Further, these voltages vary with the frequency of use of the lamp, this variation is also unpredictable. Additionally, these voltages vary from lamp to lamp, although this variation is not as significant as the variations with respect to time or frequency of use.

Conventional lamp firing mechanisms overcome this difficulty by supplying the lamp with a firing voltage which is considerably higher than the highest firing voltage anticipated. For example, if a new lamp requires a firing voltage of about 300 volts and it is predicted that after a few hundred hours of operation the firing voltage will be about 400 volts, the firing voltage supplied, throughout the life of the lamp, will perhaps be set at about 800 volts.

At the present time, the full, and excessive, firing voltage is applied to the lamp instantaneously. For example, this voltage is often generated by charging a plurality of capacitors and then applied to the lamp by closing a switch. An alternative scheme which is also in present use is to provide a voltage potential, possibly via a plurality of capacitors, and then, via a switch, impress that voltage onto the primary side of a voltage step-up transformer, the secondary of which is connected across the lamp and thus instantaneously subjecting the lamp to the full and excessive firing voltage.

The instantaneous application of the excessively high firing voltage not only causes ionic erosion and deterioration of the emitting electrode surfaces in the lamp, thus reducing lamp life, but also causes a transient signal to be impressed upon the electronic circuitry of the instrument. Such a transient can often cause false counts and errors in the digital computing system as well as exceed the tolerable voltage limits of the remainder of the instrument circuits and cause considerable disruption and interference with the normal operation thereof. This transient problem is particularly severe in instruments containing sensitive semiconductor circuitry, such as microprocessors.

SUMMARY OF THE INVENTION

Accordingly, it is one object of the present invention to provide an apparatus for firing a discharge lamp which apparatus reduces the likelihood of transients being impressed upon the related system.

This object is accomplished, at least in part, by an apparatus which includes means for supplying, before firing, only the requisite firing voltage to the lamp.

Other objects and advantages will become apparent from the following detailed description and accompanying drawing.

DETAILED DESCRIPTION OF THE INVENTION

Figure 1:
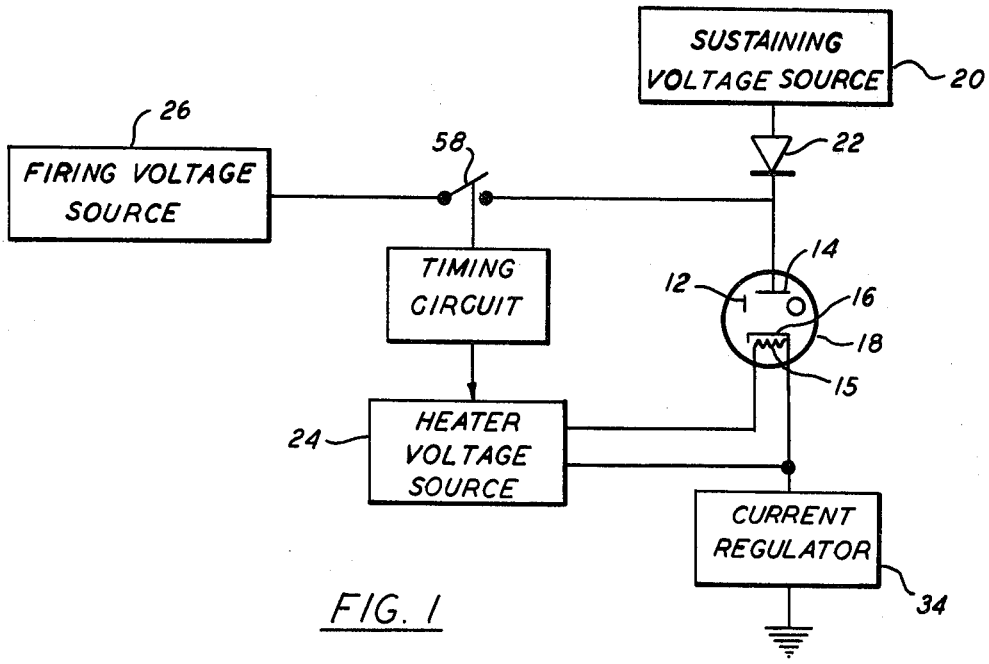
FIG. 1 is a block diagram of an apparatus embodying the principles of the present invention.

As shown in the drawing, a lamp control apparatus, generally indicated at 10 in the FIG. 1, embodying the principles of the present invention, includes a discharge lamp 12. This lamp may be a gas or vapor arc lamp operating at low or high pressure, such as a Xenon, mercury vapor or deuterium arc, and may or not have a cathode heater. In the preferred embodiment, the lamp 12 is the light source for a spectrophotometer. In this instance, for example, the lamp 12 contains deuterium gas, allowing the spectrophotometer to be operated in the untraviolet. The lamp 42 includes first and second electrically conductive elements, anode 14 and cathode 16 respectively, spaced apart within a sealed envelope 18. An auxiliary heater 15 is provided to bring the cathode 16 up to emission temperature.

The first element 14 of the lamp 12 can be selectively connected to a sustaining voltage source 20 via a blocking diode 22 and to a firing voltage source 26. A voltage source 24 is connected to the heater 15. A timing circuit 28 regulates the amount of time the full heater voltage and the firing voltage are applied to the lamp. The second element or cathode 16, of the lamp 12 is preferably connected, via a current regulator 32 to a common ground 34. While not specifically shown in the drawing, the lamp control apparatus 10 is, in fact, only one portion of the electronic circuitry of an analytical instrument employing a spectrophotometer. As such, it will be understood that rather sensitive low voltage circuitry, such as a microprocessor, would be adversely affected by large transients were they generated in the lamp control apparatus 10.

In general, to operate the lamp control apparatus 10, the timing circuit 28 is first in a condition which permits the heater voltage source 24 to supply a starting heater voltage, usually about 10 volts, to the heater 15 of lamp 12. The application of this voltage produces free electrons within the lamp 12, when the cathode 16 comes to a high enough temperature, usually a red heat.

At the same time, the firing voltage from the firing voltage source 26 is applied to the first element 14. Preferably, the firing voltage is a positively increasing ramp voltage so that the initial firing voltage impressed on the first element 14 is small and increases with time until the voltage required to fire the lamp 12 is reached. When the necessary firing voltage is reached the lamp 12 fires and the impedance thereof inherently drops as ionization builds up. Thus, not only is just the necessary firing voltage applied to the lamp 12 prior to firing, but since this voltage is built up over a period of time, any resultant transients generated are negligible. Furthermore, the drop in voltage across the lamp due to its impedance drop on firing is maintained and the magnitude of the current surge thru the lamp on firing, which is also a cause of transients, is also minimal.

Subsequent to the firing, i.e. after the preselected period of time, the timing circuit 28 switches to a second condition wherein the firing voltage is removed from the first element 14. The sustaining voltage remains applied thereto to maintain the lamp 12 in its current conducting state. The heater voltage may be reduced at this time or removed later as required by the type of lamp in use.

In the operational embodiment described above, the time segment required to reach the necessary firing voltage to the first element 14 of the lamp 12 is determined by a time control means and is usually much less than the preselected period of time during which the firing voltage is applied to the lamp 12. This is particularly desirable to ensure that the gas in the lamp 12 is fully ionized before the firing voltage is removed leaving the sustaining voltage. Nevertheless, any transients generated are negligible since, once the lamp fires, the impedance of the lamp 12 decreases at a moderate rate and the firing voltage also drops due to the increase of lamp current thru resistor 53 in series with the firing voltage supply. Since there is no excess voltage or sudden voltage changes are applied to the lamp 12, after the firing thereof, insignificant transients result. Thus, the inclusion of resistor 53 minimizes the rate of change of the voltage from the firing voltage level to the sustaining voltage level upon the firing of the lamp.

Figure 2:
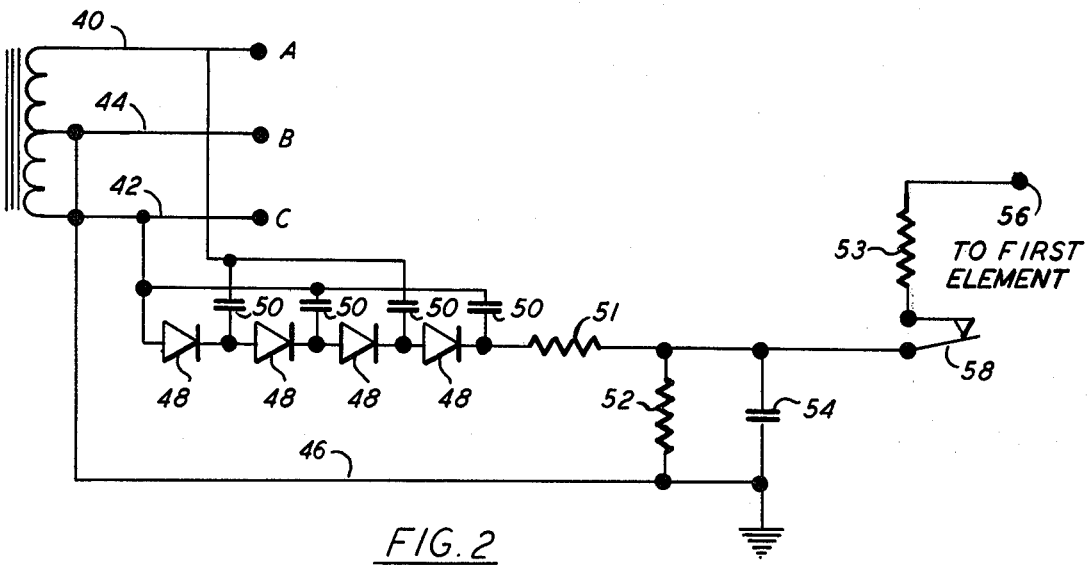
FIG. 2 is an exemplary circuit diagram of the firing voltage source and the time control block shown in FIG. 1.

One particular circuit for providing the firing voltage source 26 and the time control means is shown in FIG. 2 wherein the secondary coil 36 of a voltage step up transformer 38 has first and second end taps, 40 and 42 respectively, and a center tap 44. Preferably the primary coil, not shown, is connected to a standard AC outlet and the secondary coil 36 is such as to provide about 200 volts across the first and second end taps, 40 and 42 respectively. The center tap 44 is so located that the voltage between it and each end tap, 40 and 42, is about 100 volts. The heater voltages may be provided from another secondary coil on the transformer 38.

A voltage quadrupling means 46 is connected to the end taps 40 and 42. In this particular embodiment, as shown, the means 46 is a serial pair of voltage doubling diode/capacitor arrangements. In one design, the diodes 48 are type IN4004 and the capacitors 50 are 0.04 microfarads. The voltage quadrupling means 46 provides a potential of about 600 to 700 volts across capacitor 54. A protective discharge resistor 52 is in parallel with capacitor 54. The time control which governs the gradual increase of the firing voltage is provided by taking advantage of the progressive buildup of the output voltage of the voltage quadrupling circuit which takes place over the first four half cycles of the transformer output. Typically, on a 60 Hz supply, this buildup will take at least 33 msec. The use of a smoothing resistor 51 and capacitor 54 minimizes the step-wise nature of the buildup ramp. It has been our experience that the slope of the ramp thus formed is gradual enough to permit the lamp heater to reach an adequate emission temperature before firing takes place. It is, of course, possible to use other circuits to generate the time controlled ramp should the parameters of the lamp require this.

At the end of the preselected time, after ignition, the timing circuit energizes a relay which opens switch contact 58 and thus switches, by another contact, the heater to a lower running voltage, typically 3 volts. The sustaining voltage will now maintain the lamp 12 in a current conducting state.

Figure 3:
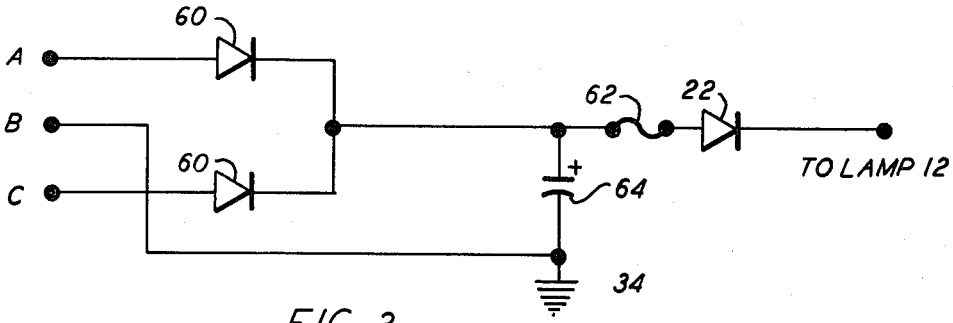
FIG. 3 is an exemplary circuit diagram of the sustaining voltage source shown in FIG. 1.

A preferred circuit for providing the sustaining voltage to the lamp 12 is shown in detail in FIG. 3. As shown by the reference terminals A, B and C, (see FIG. 2 as well) of the secondary coil 36, the transformer 38 can be employed to provide a sustaining voltage of about 130 volts. As shown, the end taps, 40 and 42, of the secondary coil 36 are joined by a pair of diodes 60 to provide about 120 volts to the fuse 62. The end taps 40 and 42, are connected to the center tap 44 via a storage capacitor 64 which is connected to the common ground 34. The sustaining voltage is provided to the first element of the lamp 12 via the blocking diode 22.

The remaining blocks shown in FIG. 1, i.e. the timing circuit 28, the heater voltage source 24 and the current regulator 32 can be implemented by well known techniques and thus it is deemed unnecessary to provide a detailed circuit diagram therefor. Nevertheless, it is preferred that the required heater voltage, since it is only on the order of about 10 volts, be provided via a separate low voltage tap winding of the transformer 38. Further, the timing circuit is preferably a time delayed relay system and can be implemented by known semiconductor circuitry to provide the sequencing taught heretofore.

Although the present invention has been described herein in reference to a particular example, it will become apparent to those skilled in the art that other embodiments and arrangements may be implemented without departing from the spirit and scope of the present invention. Thus, the description herein is considered to be exemplary only and not to be taken in a limiting fashion. The scope of the present invention is therefore defined only by the appended claims and the reasonable interpretation thereof.

What is claimed is:

1. An apparatus for reducing system transients during the firing of a discharge lamp; said apparatus comprising:

a source of voltage potential, said voltage potential being at least equal to the firing voltage of said lamp; and means for coupling said voltage potential to said lamp at a gradual rate such that only the necessary voltage is applied to said lamp prior to the firing thereof; and means for minimizing the rate of change of said voltage from firing voltage level to sustaining voltage level after firing whereby only negligible transients are generated.

2. Apparatus as claimed in claim 1 wherein said voltage coupling means initially applies a voltage to the lamp which is comparatively much lower than the firing voltage thereof.

3. Apparatus as claimed in claim 2 wherein said voltage coupling means increases the voltage to said lamp from said initial voltage to said firing voltage.

4. Apparatus as claimed in claim 3 wherein said voltage coupling means includes a voltage quadrupling circuit in series with a resistor and a capacitor.

5. Apparatus as claimed in claim 1, 2 or 3 further comprising means for electrically connecting said voltage coupling means and said lamp for a preselected period of time, said preselected period of time being sufficiently long to permit the firing of said lamp.

6. Apparatus as claimed in claim 1 wherein said lamp contains deuterium gas.

7. Apparatus as claimed in claim 1 wherein said lamp contains Xenon gas.

8. Apparatus as claimed in claim 1 wherein said lamp contains mercury vapor.

9. A method for firing a discharge lamp without generating excessive transients comprising the following steps:

applying a voltage across said lamp having a potential less than the firing voltage;

raising said voltage at a gradual rate until said lamp fires;

applying a sustaining voltage to said lamp;

removing said voltage after applying said sustaining voltage and after said lamp fires.

* * * * *

UNITED STATES PATENT AND TRADEMARK OFFICE

CERTIFICATE OF CORRECTION

PATENT NO. : 4,417,180

DATED : Nov. 22, 1983

INVENTOR(S) : Morteza M. Chamran and Milan Dimovski

It is certified that error appears in the above-identified patent and that said Letters Patent are hereby corrected as shown below:

Column 2, line 40, change "untraviolet" to --ultraviolet--,

Column 3, line 14, change "maintained" to --minimized--.

Signed and Sealed this

Seventeenth Day of April 1984

[SEAL]

Attest:

GERALD J. MOSSINGHOFF

Attesting Officer

Commissioner of Patents and Trademarks